US007447466B2

(12) United States Patent
Ikebata

(10) Patent No.: US 7,447,466 B2
(45) Date of Patent: Nov. 4, 2008

(54) IMAGE FORMING APPARATUS WITH LINK COUPLING AN IMAGE SCANNING UNIT AND AN OPENING COVER

(75) Inventor: Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 92 days.

(21) Appl. No.: 11/586,783

(22) Filed: Oct. 26, 2006

(65) Prior Publication Data

US 2007/0098440 A1 May 3, 2007

(30) Foreign Application Priority Data

Oct. 31, 2005 (JP) ..... 2005-315609

(51) Int. Cl.
*G03G 15/00* (2006.01)
*G03G 21/00* (2006.01)

(52) U.S. Cl. ..... 399/110; 399/125

(58) Field of Classification Search ..... 399/107, 399/110, 124, 125, 119, 111
See application file for complete search history.

(56) References Cited

U.S. PATENT DOCUMENTS 7,341,387 B2 * 3/2008 Nishimura et al. ..... 400/693
2002/0081133 A1 * 6/2002 Sawada ..... 399/401
2003/0047860 A1 * 3/2003 Takamatsu ..... 271/3.14
2005/0031371 A1 * 2/2005 Kaida et al. ..... 399/110
2005/0134929 A1 * 6/2005 Kim et al. ..... 358/300
2006/0140670 A1 * 6/2006 Choi et al. ..... 399/110
2007/0047028 A1 * 3/2007 Hashimoto et al. ..... 358/498

FOREIGN PATENT DOCUMENTS

JP 11-052648 A * 2/1999
JP 2001-238015 A * 8/2001
JP 2005-62326 3/2005

* cited by examiner

*Primary Examiner*—Sophia S Chen
(74) *Attorney, Agent, or Firm*—Gerald E. Hespos; Anthony J. Casella

(57) ABSTRACT

An image forming apparatus is provided with an apparatus main body for detachably accommodating at least a developing unit; an image scanning unit arranged atop the apparatus main body in such a manner as to be vertically openable and closable; an opening cover arranged at the apparatus main body in such a manner as to be vertically openable and closable in the same directions as the image scanning unit and enabling the developing unit to be mounted into and detached from the apparatus main body; and a single-parts link member for coupling the image scanning unit and the opening cover and enabling the opening cover to be opened and closed as the image scanning unit is opened and closed.

12 Claims, 8 Drawing Sheets

IMAGE FORMING APPARATUS WITH LINK COUPLING AN IMAGE SCANNING UNIT AND AN OPENING COVER

BACKGROUND OF THE INVENTION

1. Field of the Invention

The present invention relates to an image forming apparatus constructed to open and close an opening cover as an image scanning unit is opened and closed.

2. Description of the Related Art

As disclosed in Japanese Unexamined Patent Publication No. 2005-62326, there has been known an image forming apparatus constructed such that an image scanning unit (scanner) is so provided at an upper level position of the image forming apparatus as to be vertically openable and closable, and an opening cover to be opened and closed upon mounting and detaching a processing unit in and from the image forming apparatus is so provided at a middle level position of the image forming apparatus below the image scanning unit as to be vertically openable and closable in the same directions as the image scanning unit. It should be noted that the processing unit is an integral assembly of a drum unit having a photoconductive drum and a developing unit having a developing sleeve.

In this prior art, the image forming apparatus and the image scanning unit are coupled in series by at least two two-parts link members, and the link members are provided with means for holding the opening cover, whereby the opening cover is opened and closed by the holding means of the link members that move as the image scanning unit is opened and closed.

However, since such an opening and closing technique requires at least two two-parts link members and requires the link members to be provided with the holding means for the opening cover, the number of parts increases, thereby leading to a problem of an increased cost.

SUMMARY OF THE INVENTION

In order to solve the above problems, an object of the present invention is to provide an image forming apparatus which has a smaller number of parts and a reduced cost and in which an opening cover can be opened and closed as an image scanning unit is opened and closed.

In order to accomplish the above object, one aspect of the present invention is directed to an image forming apparatus, comprising an apparatus main body detachably accommodating at least a developing unit; an image scanning unit arranged atop the apparatus main body in such a manner as to be vertically openable and closable; an opening cover arranged at the apparatus main body in such a manner as to be vertically openable and closable in the same directions as the image scanning unit and enabling the developing unit to be mounted into and detached from the apparatus main body; and a single-parts link member for coupling the image scanning unit and the opening cover and enabling the opening cover to be opened and closed as the image scanning unit is opened and closed.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, a best mode for embodying the present invention is described in detail with reference to the accompanying drawings.

Figure 1:
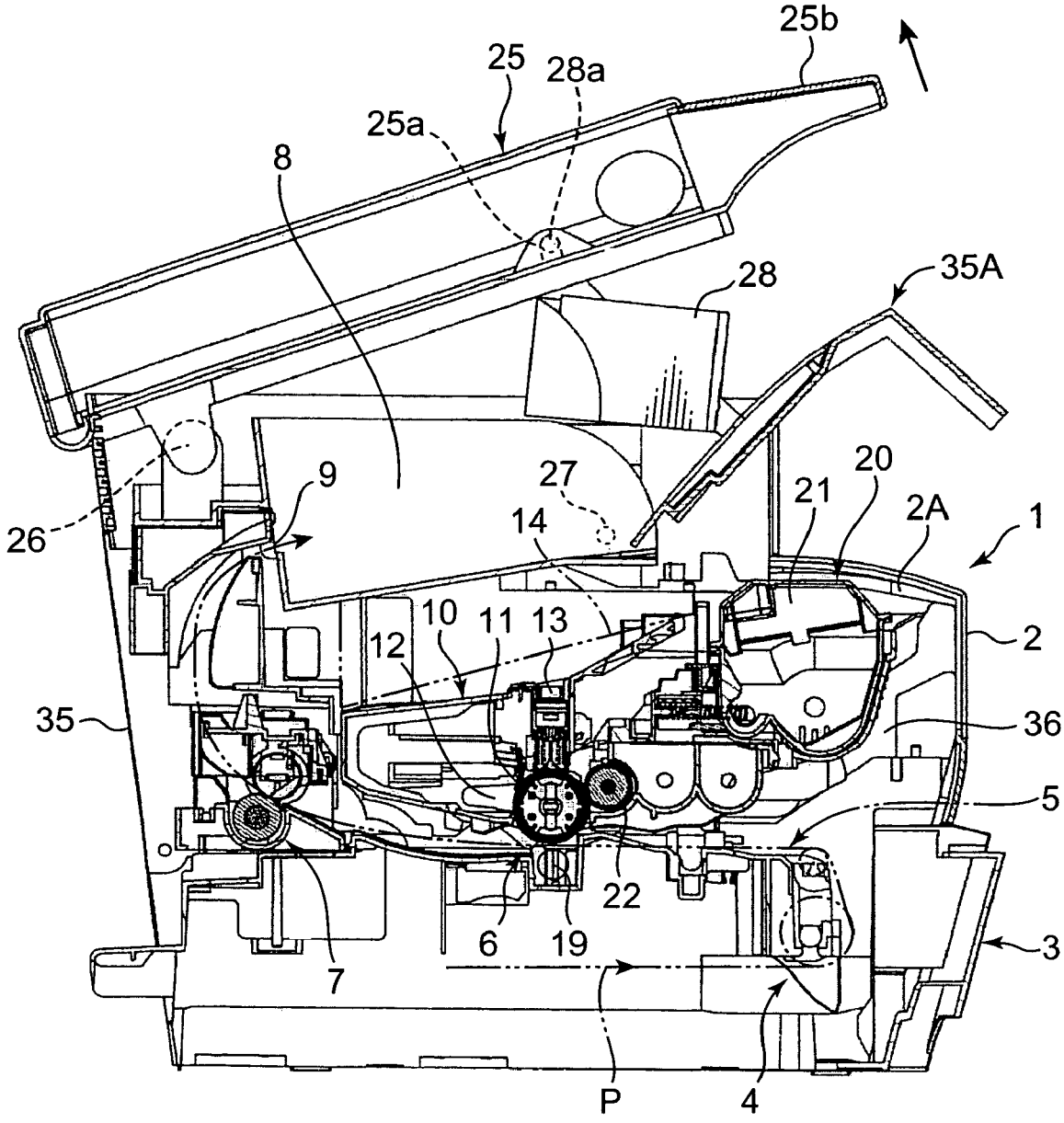
FIG. 1 is a side view in section of an image forming apparatus according to one embodiment of the invention with an image scanning unit and an opening cover opened.
Figure 3:
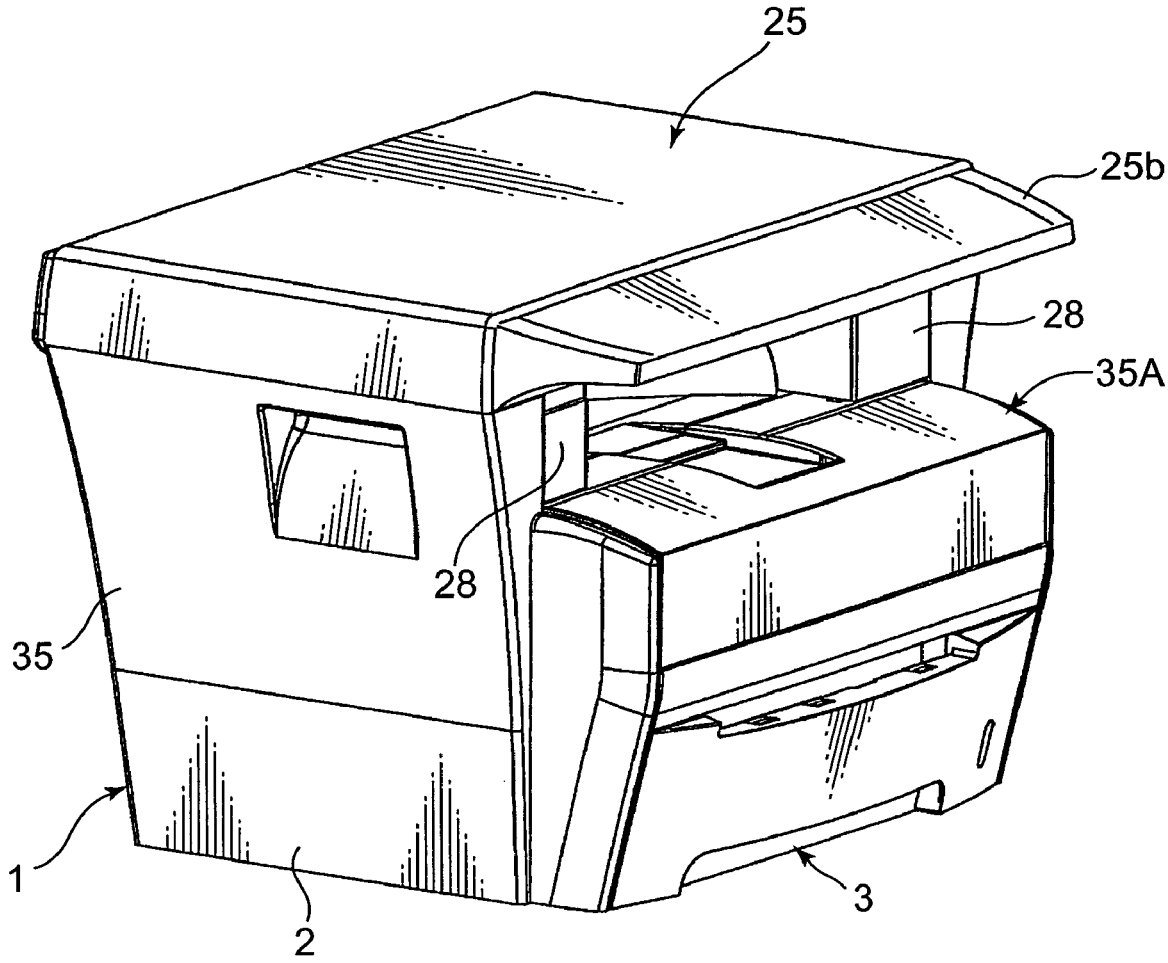
FIG. 3 is a perspective view of the image forming apparatus of FIG. 1 with the image scanning unit and the opening cover closed.
Figure 4:
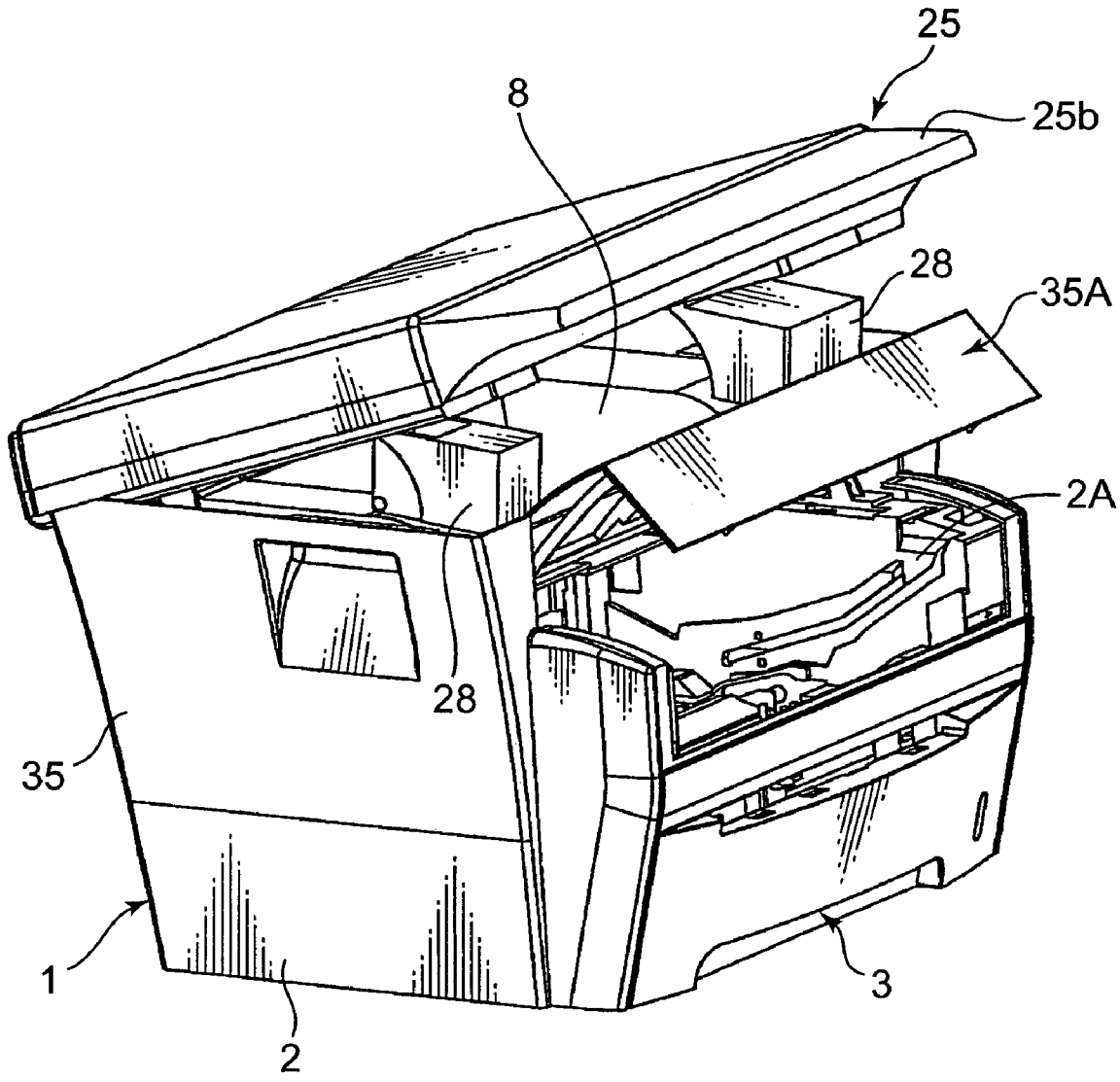
FIG. 4 is a perspective view of the image forming apparatus of FIG. 1 with the image scanning unit and the opening cover opened.
Figure 5A:
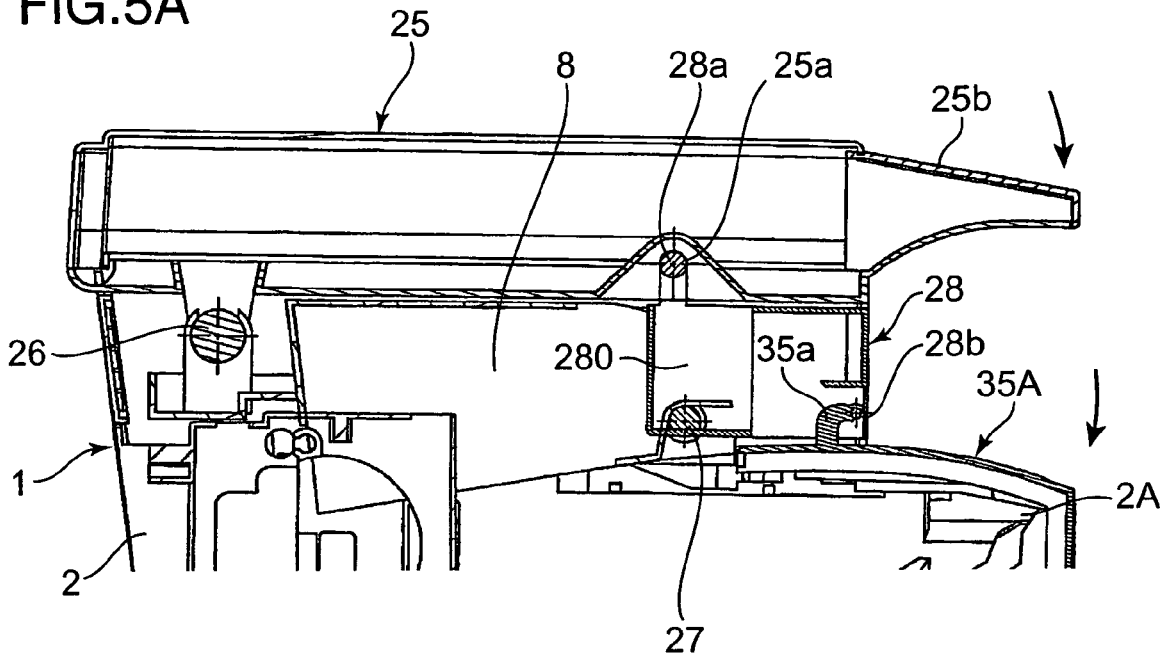
FIG. 5A is a side view in section showing an essential portion of the image forming apparatus with the image scanning unit and the opening cover closed, and FIG. 5B a side view in section showing the essential portion of the image forming apparatus with the image scanning unit and the opening cover opened.

FIG. 1 is a side view in section of an image forming apparatus 1, wherein an image scanning unit 25 and an opening cover 35A are opened relative to an apparatus main body 3. Normally, the image scanning unit 25 and the opening cover 35A are closed as shown in FIGS. 3 and 5A.

The image forming apparatus 1 includes the apparatus main body 2 in the form of a rectangular box, the image scanning unit (ISU: scanner) 25 provided to be vertically openable and closeable relative to the apparatus main body 2, and the opening cover 35A. Specifically, the image scanning unit 25 is so provided at a position corresponding to an upper level of the image forming apparatus 1 as to be vertically openable and closable. The opening cover 35A that is opened and closed upon mounting and detaching a developing unit 20 and the like into and from the image forming apparatus 1 is so provided at a position corresponding to a middle level of the image forming apparatus 1 below the image scanning unit 25 as to be vertically openable and closable in the same directions as the image scanning unit 25. A construction and the like for opening the image scanning unit 25 and the opening cover 35A are described in detail later.

A sheet feeding assembly 4 for feeding a sheet P from a sheet tray 3, a sheet conveying assembly 5 for conveying the sheet P fed from the sheet feeding assembly 4, an image forming assembly 6 for transferring a toner image to the sheet P conveyed by the sheet conveying assembly 5, a fixing device 7 for fixing the toner image to the sheet P having the toner image transferred thereto, and a discharging assembly 9 for discharging the sheet P having the toner image fixed in the fixing device 7 onto a discharge tray 8 are provided in the apparatus main body 2.

The image forming assembly 6 includes a drum unit 10 having a photoconductive drum 11, the developing unit 20 having a developing sleeve 22, a transfer roller 19 for transferring a toner image on the outer circumferential surface of the photoconductive drum 11 to a sheet P, and the like. The drum unit 10 and the developing unit 20 are separate units, and can be detached from and mounted into the apparatus main body 2 at the time of a jam processing and an exchange. The developing unit 20 may be detachably mountable while the drum unit 10 may be fixed in the apparatus main body 2 or a processing unit as an integral assembly of the drum unit 10 and the developing unit 20 may be detachably mountable.

The apparatus main body 2 is covered by an outer covering 35. A loading opening 2A through which the drum unit 10 and the developing unit 20 are mounted and detached is formed in the front part of the apparatus main body 2. The opening cover 35A is provided vertically rotatably about a pivot 27 (see FIG. 5) so as to be able to open and close the loading opening 2A.

A cleaner 12 for removing toner residual on the outer circumferential surface of the photoconductive drum 11, a charger 13 for uniformly charging the outer circumferential surface of the photoconductive drum 11, a charge remover (not shown) for removing residual charges are arranged around the photoconductive drum 11 of the drum unit 10. A laser beam is emitted from an LSU (exposing device) 14 to be incident on the photoconductive drum 11.

Two upper and lower guiding surfaces 37, 38 (see FIG. 2) are formed on the inner surface of each of main frames 36 located at the opposite inner sides of the loading opening 2A. The drum unit 10 is guided by the guiding surfaces 37, 38 to be inserted to a specified mount position.

Figure 2:
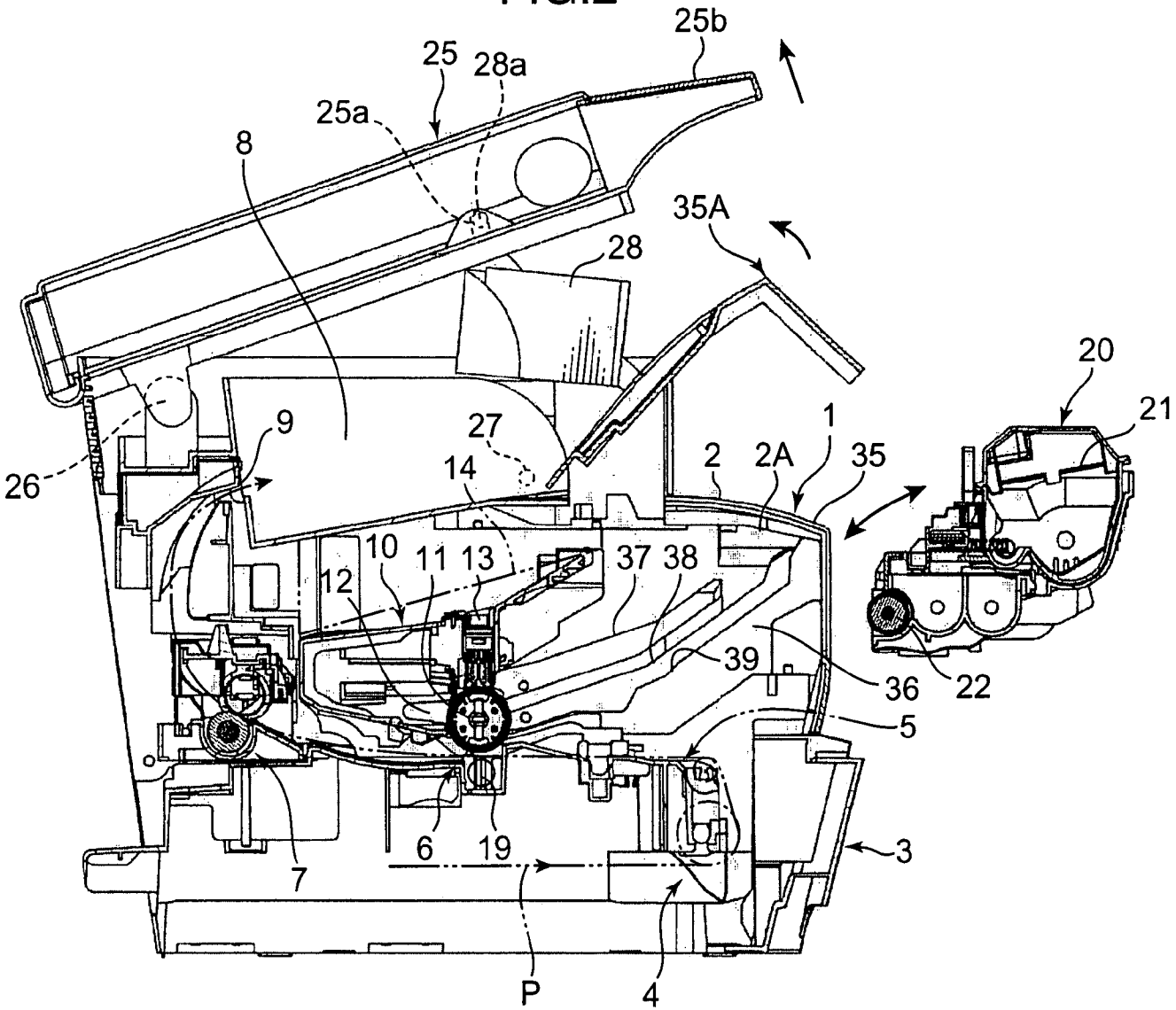
FIG. 2 is a side view in section of the image forming apparatus of FIG. 1 with a developing unit detached.

FIG. 2 is a side view in section of the image forming apparatus 1 before the developing unit 20 is inserted into the apparatus main body 2 mounted with the drum unit 10. The developing unit 20 includes the developing sleeve 22 at a bottom part of its side to face the photoconductive drum 11, and this developing sleeve 22 faces the photoconductive drum 11 while defining a specified development gap thereto when the developing unit 20 is mounted into the apparatus main body 2. The developing sleeve 22 is for supplying toner particles to an electrostatic latent image formed on the photoconductive drum 11 for the image development.

A toner container 21 accommodating toner particles containing magnetic materials is provided at a position of the developing unit 20 opposite to the developing sleeve 22.

A stepped guiding surface 39 is also formed on the inner surface of each of the main frames 36 located at the opposite inner sides of the loading opening 2A. The developing unit 20 is also guided by the guiding surfaces 39 to be inserted to the specified mounted position.

As shown in FIGS. 1 to 5, the image scanning unit 25 at the upper level position of the image forming apparatus 1 is mounted to be vertically openable and closable about a pivot 26 provided near one side (left side in FIGS. 1 and 2) of the apparatus main body 2 of the image forming apparatus 1. Further, the opening cover 35A at the middle level position of the image forming apparatus 1 is mounted to be vertically openable and closable about the pivot 27 provided near the other side (right side in FIGS. 1 and 2) of the apparatus main body 2 of the image forming apparatus 1.

More specifically, if the detaching direction of the drum unit 10 and the developing unit 20 is assumed to be forward direction, the image scanning unit 25 has a size substantially conforming to that of the apparatus main body 2 and is vertically rotatable about the pivot 26 provided near the rear end of the upper surface of the apparatus main body 2. Further, the opening cover 35A has such a size as to partially cover a front part of the upper surface of the apparatus main body 2 and is vertically rotatable about the pivot 27 provided near the rear end of the opening cover 35A.

A single-parts link member 28 in the form of a rectangular box is provided at each of left and right positions in a clearance between the image scanning unit 25 and the opening cover 35A.

Figure 5B:
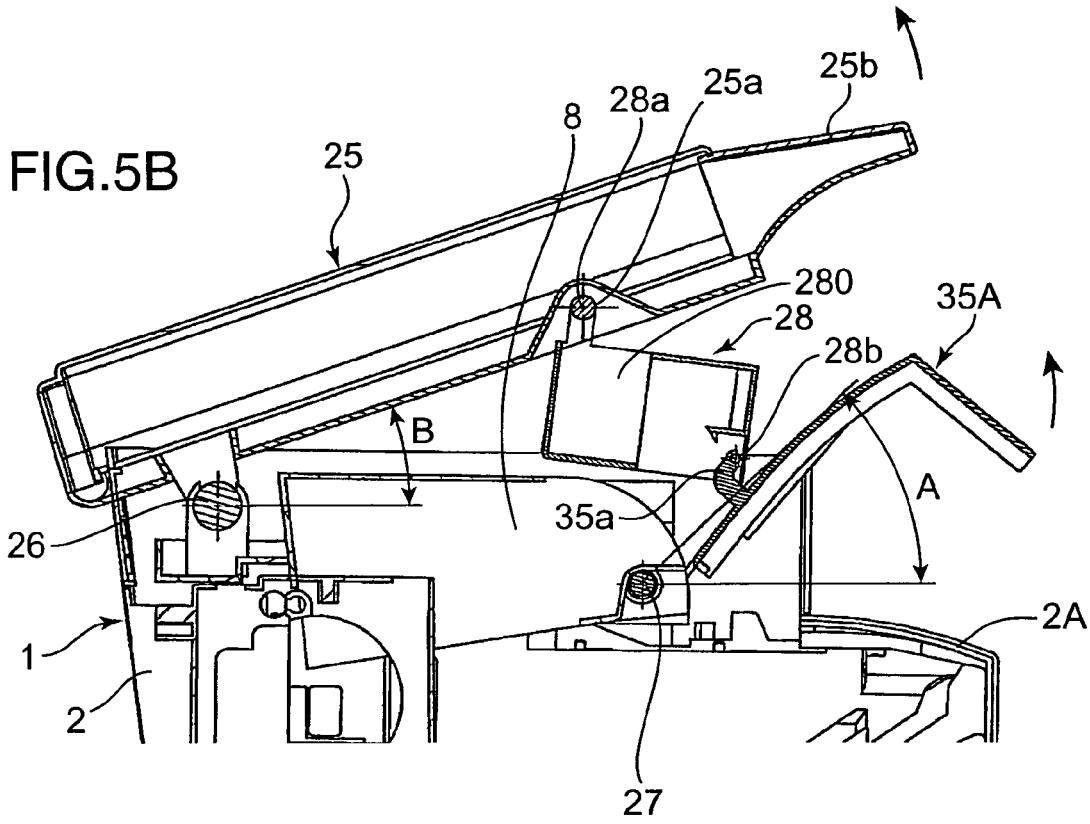

As shown in FIGS. 5A, 5B and also 6A and 6B, each single-parts link member 28 includes a rectangular main portion 280 that is a box member having a laterally long rectangular shape in side view, coupling pins 28*a* (first coupling pins) projecting from one corner portion of the rectangular main portion 280 and coupling pins 28*b* (second coupling pin) provided at a corner portion diametrically opposed to the former one.

The rectangular main portion 280 has a height substantially equal to the height of the clearance between the image scanning unit 25 and the opening cover 35A in their closed state (see FIGS. 3 and 5A).

Figure 6A:
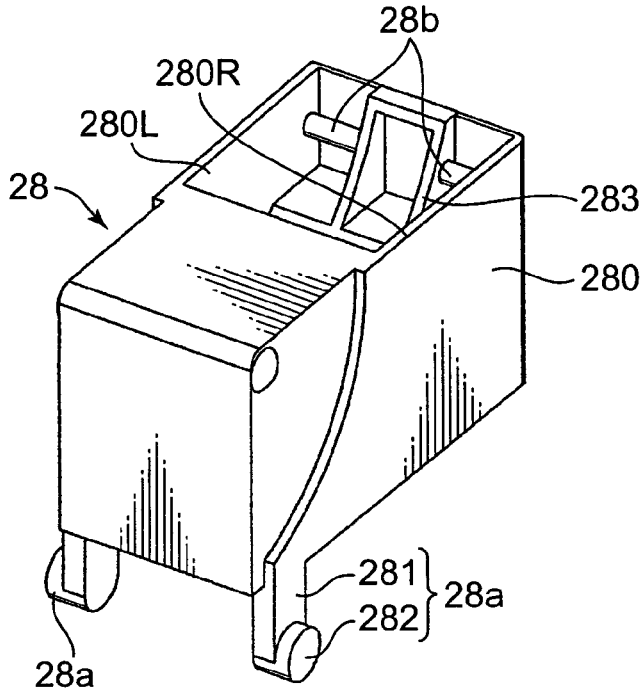
FIG. 6A is a perspective view of a single-parts link member and FIG. 6B is a perspective view showing an essential portion of the opening cover.
Figure 6B:
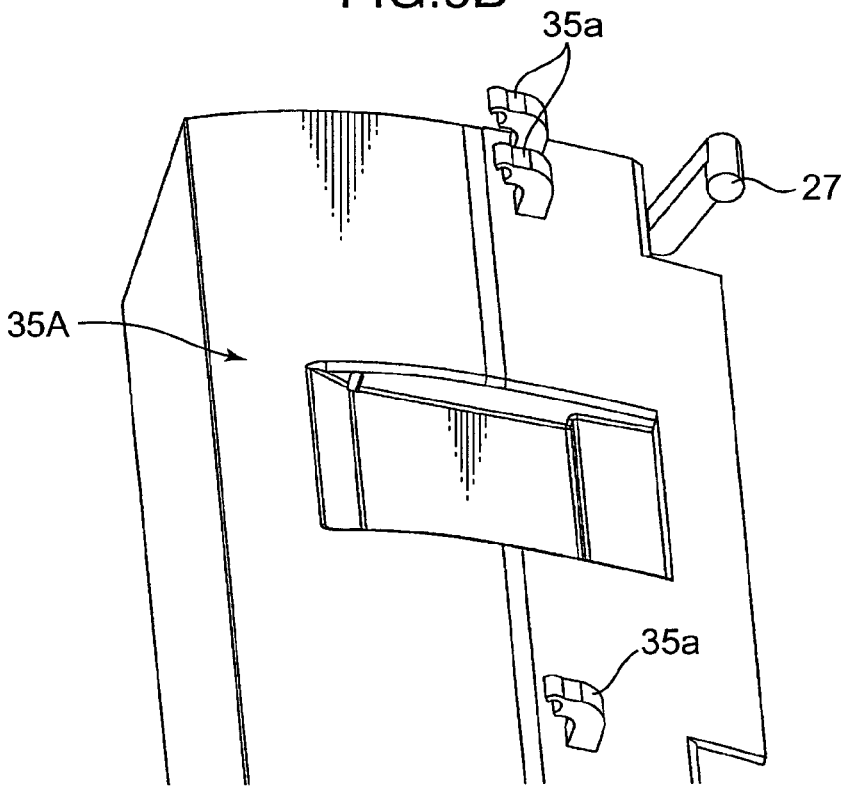

With reference to FIG. 6A, the coupling pins 28*a* are comprised of a pair of projecting pieces 281 projecting from corners of left and right side plates 280L, 280R of the rectangular main portion 280, and short shaft members 282 integrally provided at the leading ends of the projecting pieces 281. On the other hand, the coupling pins 28*b* are comprised of a pair of shaft members mounted between the left and right side plates 280L and 280R while sandwiching a rib member 283 in the middle inside the diametrical corner of the rectangular main portion 280.

The coupling pins 28*a* are rotatably coupled to the lower surface of the image scanning unit 25 at the leading side (front side) of the image scanning unit 25, whereas the coupling pins 28*b* are rotatably coupled to the upper surface of the opening cover 35A at the rear side of the opening cover 35A. Specifically, the coupling pins 28*a* are rotatably coupled to coupling portions 25*a* provided on the lower surface of the image scanning unit 25 at positions substantially right above the pivot 27 of the opening cover 35A. Further, the coupling pins 28*b* are rotatably coupled to coupling portions 35*a* provided on the upper surface of the opening cover 35A at positions before the pivot 27 of the opening cover 35A.

Figure 7:
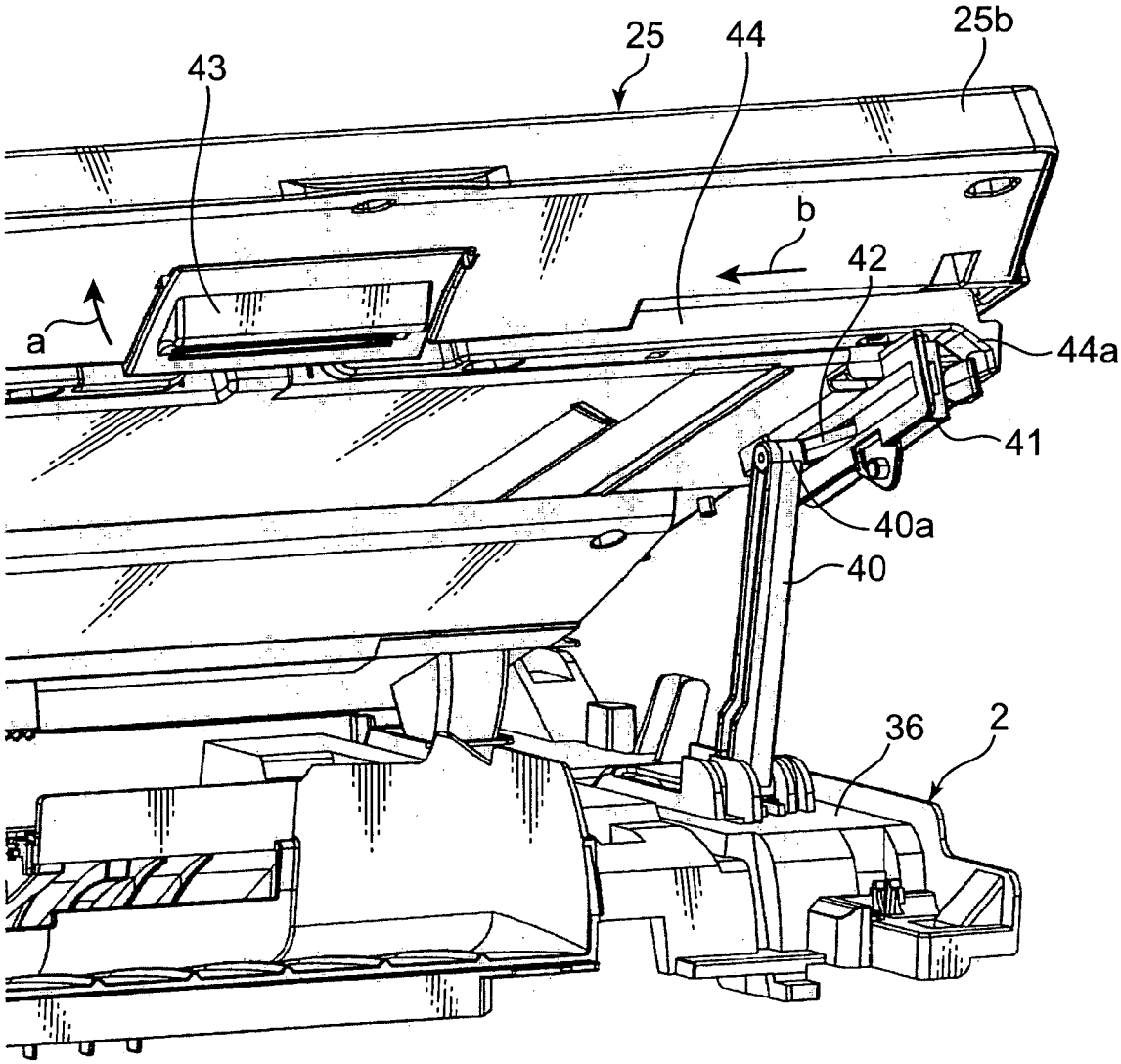
FIG. 7 is a perspective view showing an essential portion from an inner side with the image scanning unit opened.
Figure 8:
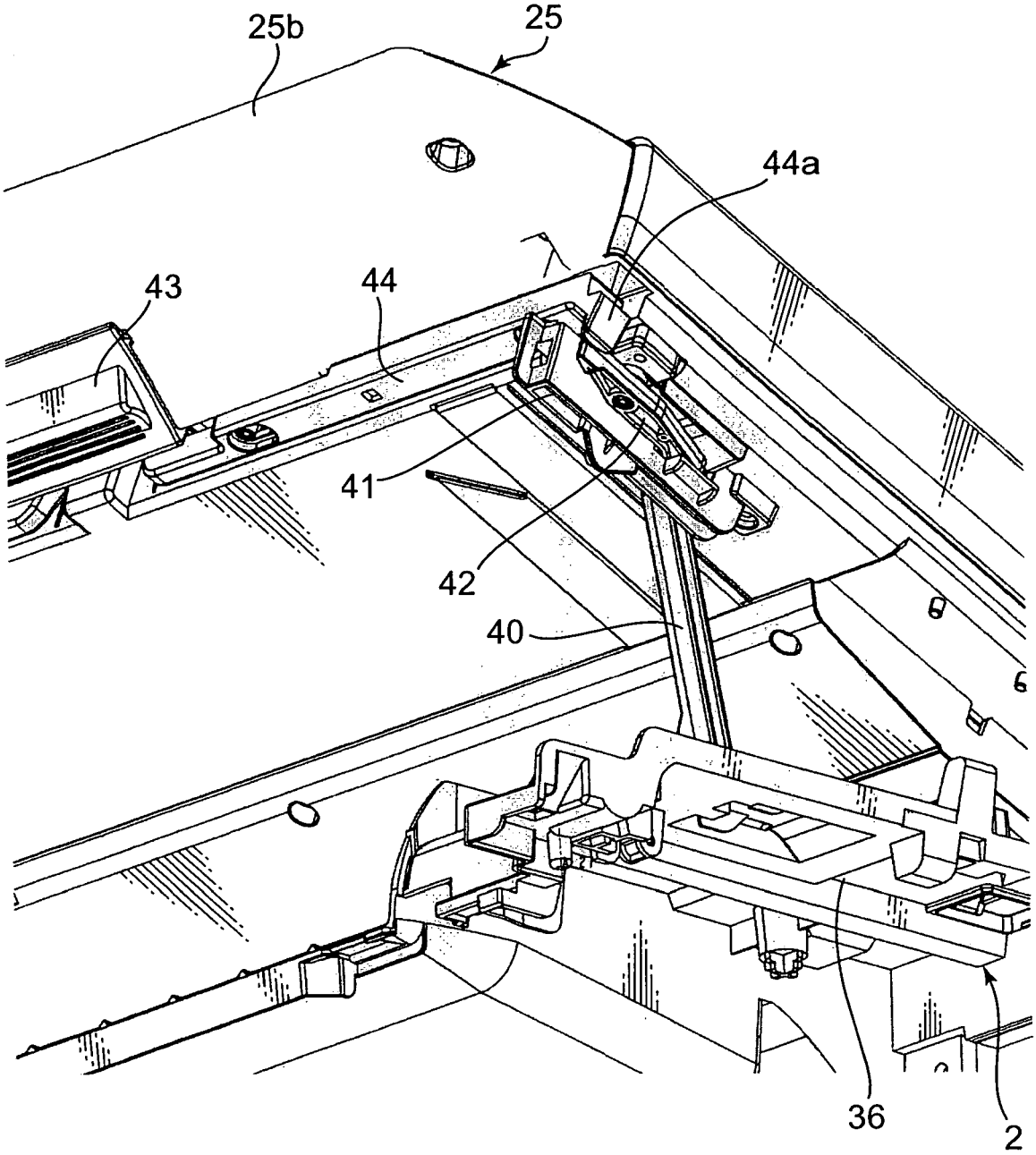
FIG. 8 is a perspective view showing the essential portion from an outer side with the image scanning unit opened.

As shown in FIGS. 7 and 8, the bottom end of a stay member 40 is so coupled to the top of the main frame 36 inside the apparatus main body 2 as to be vertically rotatable. A guiding member 41 formed with a guiding groove for slidably guiding an upper pin 40*a* of the stay member 40 in forward and backward directions is provided at the bottom part of the image scanning unit 25. By such a construction, the stay member 40 is raised as the image scanning unit 25 is opened while being laid down as the image scanning unit 25 is closed.

The guiding member 41 has a lock lever 42 for locking the upper pin 40*a* at a raised position of the stay member 40. The image scanning unit 25 can be locked in its opened state by the lock lever 42.

A handle-shaped operation lever 43 operated in a direction of arrow "a" by hand is mounted at a widthwise middle position of the lower part of the leading end portion 25*b* of the image scanning unit 25. An interlocking lever 44 movable in a direction of arrow "b" (inwardly) as the operation lever 43 is pushed is also mounted. When the interlocking lever 44 is moved in the direction of arrow "b", the lock lever 42 is pivoted in unlocking direction by an interlocking portion 44*a* of the interlocking lever 44, whereby the upper pin 40*a* of the stay member 40 is unlocked.

If the image forming apparatus 1 is constructed as above, the opening cover 35A is opened upward as the image scanning unit 25 is opened upward. Specifically, a user places his fingers at the leading end portion 25*b* of the image scanning unit 25 to open the image scanning unit 25 upward at the time of a jam processing or an exchange with the image scanning unit 25 closed (see FIGS. 3 and 5). Then, the opening cover 35A are opened upward by the single-parts link members 28 being lifted up by the image scanning unit 25 (see FIGS. 1, 2, 4 and 5B).

The image scanning unit 25 is locked in its opened state by the upper pin 40*a* of the raised stay member 40 being locked by the lock lever 42. Thus, the opening cover 35A is also kept opened, wherefore a jam processing can be performed or the developing unit 20 can be exchanged by detaching the developing unit 20 and the like.

If the user pushes the operation lever 43 of the image scanning unit 25 after the jam processing, the lock lever 42 is pivoted in unlocking direction by the interlocking lever 44, whereby the upper pin 40*a* of the stay member 40 is unlocked. If the user further closes the image scanning unit 25 downward, the opening cover 35A is closed downward by the single-parts link members 28 being pushed down by the image scanning unit 25.

By coupling the image scanning unit 25 and the opening cover 35A by the single-parts link members 28 in this way, the opening cover 35A can be opened and closed by the single-parts link members 28 as the image scanning unit 25 is opened and closed. Accordingly, unlike the prior art, it is necessary neither to provide two-parts link members nor to provide the single-parts link members 28 with holding means for the opening cover 35A. Thus, the number of parts decreases to reduce the cost.

Further, since the single-parts link members 28 are in the form of rectangular boxes and are provided at the left and right positions in the clearance between the image scanning unit 25 and the opening cover 35A, an internal mechanism is difficult to see by the single-parts link members 28 hiding the clearance (see FIG. 3), wherefore appearance can be improved.

Further, in this embodiment, the image scanning unit 25 has the pivot 26 near the one side of the image forming apparatus 1, the opening cover 35A has the pivot 27 near the other side of the image forming apparatus 1, and the single-parts link members 28 are coupled to the leading end side of the image scanning unit 25 and the rear side of the opening cover 35A via the coupling pins 28*a*, 28*b*. Thus, an opening angle A of the opening cover 35A can be made larger than an opening angle B of the image scanning unit 25 as shown in FIG. 5B, wherefore, operability is good at the time of mounting and detaching the developing unit 20 and performing the jam processing.

The aforementioned specific embodiment mainly embraces features of the inventions having the following constructions.

An image forming apparatus according to one aspect of the present invention comprises an apparatus main body for detachably accommodating at least a developing unit; an image scanning unit arranged atop the apparatus main body in such a manner as to be vertically openable and closable; an opening cover arranged on the apparatus main body in such a manner as to be vertically openable and closable in the same directions as the image scanning unit and enabling the developing unit to be mounted into and the detached from the apparatus main body; and a single-parts link member for coupling the image scanning unit and the opening cover and enabling the opening cover to be opened and closed as the image scanning unit is opened and closed.

With this construction, by coupling the image scanning unit and the opening cover by the single-parts link member, the opening cover can be opened and closed by the single-parts link member as the image scanning unit is opened and closed. Accordingly, unlike the prior art, it is not necessary to provide two-parts link members and to provide the single-parts link member with holding means for the opening cover. Thus, the number of parts decreases to reduce the cost.

In the above construction, the single-parts link member is preferably formed to have a rectangular box shape and provided at each of left and right positions in a clearance between the image scanning unit and the opening cover. With this construction, since the single-parts link members are formed to have a rectangular box shape and provided at the left and right positions in the clearance between the image scanning unit and the opening cover, an internal mechanism is difficult to see by being hidden by the single-parts link members, whereby appearance can be improved.

In this case, each single-parts link member preferably includes a rectangular main portion having a height substantially equal to the height of the clearance between the image scanning unit and the opening cover with the image scanning unit and the opening cover closed, a first coupling pin disposed near one corner portion of the rectangular main portion and rotatably coupled to the bottom surface of the image scanning unit, and a second coupling pin disposed near a corner portion of the rectangular main portion diametrically opposed to the corner portion where the first coupling pin is disposed and rotatably coupled to the upper surface of the opening cover. With such a construction, a mechanism for smoothly interlocking the movements of the image scanning unit and the opening cover can be realized by a simple construction, namely the single-parts link members having the first and second coupling pins disposed at the diametrical corner portions of the rectangular main portion.

In the above construction, it is preferable that the image scanning unit includes a pivot near one side of the image forming apparatus, the opening cover includes a pivot near the other side of the image forming apparatus, and the single-parts link member is coupled to a leading end side of the image scanning unit and a rear end side of the opening cover.

With this construction, an opening angle of the opening cover can be made larger than that of the image scanning unit by adjusting the positions of the pivots of the image scanning unit and the opening cover and the coupled positions of the single-parts link member. Thus, operability is good at the time of mounting and detaching the developing unit or the like and performing a jam processing.

In the above construction, in the case where the developing unit is mounted into and detached from the image forming apparatus along the forward direction of the image forming apparatus, it is preferable that the image scanning unit has a size substantially conforming to that of the apparatus main body and has a pivot near the rear end of the upper surface of the apparatus main body, that the opening cover has such a size as to partially cover a front part of the upper surface of the apparatus main body and has a pivot near the rear end of the opening cover, and that the single-parts link member is coupled near the front side of the image scanning unit and the rear side of the opening cover. With this construction, a mechanism for interlocking movements of the image scanning unit having the size substantially conforming to that of the apparatus main body and the opening cover having such a size as to partially cover the front part of the upper surface of the apparatus main body can be built using a small number of parts.

In this case, it is preferable that the single-link includes a rectangular main portion having a height substantially equal to the height of the clearance between the image scanning unit and the opening cover with the image scanning unit and the opening cover closed, a first coupling pin disposed near one corner portion of the rectangular main portion and rotatably coupled to the bottom surface of the image scanning unit, and a second coupling pin disposed near a corner portion of the rectangular main portion diametrically opposed to the corner portion where the first coupling pin is disposed and rotatably coupled to the upper surface of the opening cover, that the first coupling pin is coupled to the bottom surface of the image scanning unit at a position substantially right above the pivot of the opening cover and that the second coupling pin is coupled to the upper surface of the opening cover at a position before the pivot of the opening cover.

With such a construction, the image scanning unit and the opening cover are coupled at suitable positions by the single-parts link member including the first and second coupling pins diametrically disposed at the rectangular main portion. Thus, movements of the image scanning unit and the opening cover can be smoothly interlocked by a simple construction.

This application is based on patent application No. 2005-315609 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body for detachably accommodating at least a developing unit, an image scanning unit arranged atop the apparatus main body and pivotally connected to the apparatus main body in such a manner as to be vertically openable and closable, an opening cover pivotally connected to the apparatus main body in such a manner as to be vertically openable and closable in the same directions as the image scanning unit and enabling the developing unit to be mounted into and detached from the apparatus main body, and a single-parts link member for coupling the image scanning unit and the opening cover and enabling the opening cover to be opened and closed as the image scanning unit is opened and closed.

2. An image forming apparatus according to claim 1, wherein the single-parts link member is formed to have a rectangular box shape and disposed at each of left and right positions in a clearance between the image scanning unit and the opening cover.

3. An image forming apparatus according to claim 1, wherein the image scanning unit is pivotally connected to the apparatus main body at a first pivot and wherein the opening cover is pivotally connected to the apparatus main body at a second pivot spaced from the first pivot.

4. An image forming apparatus according to claim 3, wherein a second pivot is spaced from the image scanning unit.

5. An image forming apparatus according to claim 3, wherein the single-parts linking member is connected pivotally to the image scanning unit at the third pivot spaced from the first and second pivots and wherein the single-parts link member connected pivotally to the opening cover at a fourth pivot spaced from the first, second and third pivots.

6. An image forming apparatus according to claim 5, wherein the single-parts link member is configured to maintain a fixed distance between the third and fourth pivots.

7. An image forming apparatus according to claim 5, wherein a distance between the first and third pivots exceeds a distance between the second and fourth pivots so that an angular rotation of the image scanning unit around the first pivot generates a greater angular rotation of the opening cover around the second pivot.

8. An image forming apparatus according to claim 1, wherein the single-parts link member is disposed and configured such that any pivoting of the image scanning unit relative to the apparatus main body generates a pivoting movement of the opening cover relative to the apparatus main body.

9. An image forming apparatus, comprising:

an apparatus main body for detachably accommodating at least a developing unit, an image scanning unit arranged atop the apparatus main body in such a manner as to be vertically openable and closable, an opening cover arranged at the apparatus main body in such a manner as to be vertically openable and closable in the same directions as the image scanning unit and enabling the developing unit to be mounted into and detached from the apparatus main body, and a single-parts link member for coupling the image scanning unit and the opening cover and enabling the opening cover to be opened and closed as the image scanning unit is opened and closed, wherein the single-parts link member includes:

a rectangular main portion having a height substantially equal to the height of a clearance between the image scanning unit and the opening cover with the image scanning unit and the opening cover closed, a first coupling pin disposed near one corner portion of the rectangular main portion and rotatably coupled to the bottom surface of the image scanning unit, and a second coupling pin disposed near a corner position of the rectangular main portion opposed to the corner portion where the first coupling pin is disposed and rotatably coupled to the upper surface of the opening cover.

10. An image forming apparatus, comprising:

an apparatus main body for detachably accommodating at least a developing unit, an image scanning unit arranged atop the apparatus main body in such a manner as to be vertically openable and closable, wherein:

an opening cover arranged at the apparatus main body in such a manner as to be vertically openable and closable in the same directions as the image scanning unit and enabling the developing unit to be mounted into and detached from the apparatus main body, the image scanning unit has a pivot near one side of the image forming apparatus, the opening cover has a pivot near the other side of the image forming apparatus, and a single-parts link member for coupling the image scanning unit and the opening cover and enabling the opening cover to be opened and closed as the image scanning unit is opened and closed, the single-parts link member is coupled to a leading end side of the image scanning unit and a rear end side of the opening cover.

11. An image forming apparatus, comprising:

an apparatus main body for detachably accommodating at least a developing unit, an image scanning unit arranged atop the apparatus main body in such a manner as to be vertically openable and closable, an opening cover arranged at the apparatus main body in such a manner as to be vertically openable and closable in the same directions as the image scanning unit and enabling the developing unit to be mounted into and detached from the apparatus main body, and a single-parts link member for coupling the image scanning unit and the opening cover and enabling the opening cover to be opened and closed as the image scanning unit is opened and closed, wherein, in the case where the developing unit is mounted into and detached from the image forming apparatus along the forward direction of the image forming apparatus, the image scanning unit has a size substantially conforming to that of the apparatus main body and has a pivot near the rear end of the upper surface of the apparatus main body, the opening cover has such a size as to partially cover a front part of the upper surface of the apparatus main body and has a pivot near the rear end of the opening cover, and the single-parts link member is coupled near a front part of the image scanning unit and a rear end part of the opening cover.

12. An image forming apparatus according to claim 11, wherein the single-parts link member includes:

a rectangular main portion having a height substantially equal to the height of a clearance between the image scanning unit and the opening cover with the image scanning unit and the opening cover closed, a first coupling pin disposed near one corner portion of the rectangular main portion and rotatably coupled to the bottom surface of the image scanning unit, and a second coupling pin disposed near a corner position of the rectangular main portion opposed to the corner portion where the first coupling pin is disposed and rotatably coupled to the upper surface of the opening cover, the first coupling pin being coupled to the bottom surface of the image scanning unit at a position substantially right above the pivot of the opening cover and the second coupling pin being coupled to the upper surface of the opening cover at a position before the pivot of the opening cover.

* * * * *